United States Patent [19]

Good

[11] Patent Number: 4,869,430

[45] Date of Patent: Sep. 26, 1989

[54] PIN JET NOZZLE

[76] Inventor: Mark D. Good, 68 Wyckoff Ave., Wyckoff, N.J. 07481

[21] Appl. No.: 181,046

[22] Filed: Apr. 13, 1988

[51] Int. Cl.[4] ..... B05B 1/26

[52] U.S. Cl. ..... 239/524

[58] Field of Search ..... 239/512, 591, 596, 518, 239/524, 461, 513–517, 519

[56] References Cited

U.S. PATENT DOCUMENTS

| | | | |
|---|---|---|---|
| 2,058,823 | 10/1936 | Pigott . | |
| 2,132,720 | 10/1938 | Christensen, Jr. | 239/515 |
| 2,410,215 | 10/1946 | Houghton . | |
| 2,540,663 | 2/1951 | Garey | 239/518 X |
| 2,701,165 | 2/1955 | Bete et al. | 239/512 X |
| 2,778,685 | 1/1957 | Umbricht | 239/518 |
| 3,788,542 | 1/1974 | Mee | 239/524 X |
| 3,894,691 | 7/1975 | Mee | 239/512 X |

FOREIGN PATENT DOCUMENTS

| | | | |
|---|---|---|---|
| 226611 | 11/1985 | Japan | 239/596 |
| 1333651 | 10/1973 | United Kingdom | 239/518 |

*Primary Examiner*—Andres Kashnikow

*Attorney, Agent, or Firm*—Robert Charles Beam

[57] ABSTRACT

An improved pin jet nozzle is disclosed wherein the improvement comprises a delivery channel having the same diameter as the outlet orifice and having a length of at least three times its diameter.

6 Claims, 1 Drawing Sheet

PIN JET NOZZLE

FIELD OF THE INVENTION

The present invention relates to a pin jet nozzle for use in a pressurized evaporative cooling system.

BACKGROUND OF THE INVENTION

Evaporative cooling systems have been employed in various applications for a number of years. Such systems typically involve a pressurized fluid, usually water, escaping through a small orifice and impinging on a proximate surface. The force of the pressurized stress against the surface causes the fluid to disperse into minute particles creating a localized fog or mist.

Because of the difficulty in precisely cutting the small diameter orifice and delivery channel, such prior art nozzles have typically been formed from brass and other relatively soft metals because of the difficulty in working. Recently, some nozzles have been produced in stainless steel, however such nozzles still follow the design of previous nozzles.

The short delivery channels of the prior art appeared to be necessary because of the limitations of metalworking. Cutting a narrow orifice, typically on the order of six one-thousandths of an inch (0.006 inch), is typically done with a pin drill, usually a stationary drill which engages rotating work. The depth which can be achieved with such a metalworking procedure, typically no greater than fifteen one-thousandths of an inch (0.015 inch), is chiefly a function of how well the drill bit can be supported during the metalworking process.

Further, the nature of the metalworking employed to cut the orifice and delivery channel is such that the integrity of the orifice and channel walls is difficult to maintain. The drilling operation is known to gouge and scar the interior surface of the delivery channel and leave an imprecise mouth to the orifice itself.

OBJECTS OF THE PRESENT INVENTION

It is an object of the present invention to provide an improved pin jet nozzle having a delivery channel of greater length.

It is a further object of the present invention to provide an improved pin jet nozzle having a delivery channel with an interior surface unmarked by metalworking.

It is a still further object of the present invention to provide an improved pin jet nozzle having an orifice of greater integrity.

The other objects, features and advantges of the present invention will become more apparent in light of the following detailed description of the preferred embodiment thereof.

According to the present invention, there is provided an improved pin jet nozzle which comprises:

- a base portion itself comprising:
  - means for connection of said nozzle to a pressurized hydraulic system;
  - means for receiving fluid from said system; and
  - an orifice component, said orifice component comprising:
    - an inlet adapted to receive fluid from said system;
    - a small-diameter outlet orifice for the release of fluid from said system in the form of a jet; and
    - a delivery channel adapted to convey fluid from said inlet to said small-diameter outlet orifice; and
- a pin portion itself comprising:
  - support and centering means; and
  - an impingement pin member positioned over said outlet orifice and in the path of said fluid jet;

wherein the improvement comprises a delivery channel having the same diameter as said outlet orifice and having a length of at least three times its diameter.

DETAILED DESCRIPTION OF THE PRESENT INVENTION

As with any pressurized discharge, the length and integrity of the cylindrical barrel from which the discharge issues will help determine the quality of its trajectory. This was true in the days of the "Pennsylvania" rifle and remains true today. The necessities of metalworking in the manufacture of pin jet nozzle has, in the past, limited the length of the delivery channel, or barrel, of the nozzle. The integrity of the interior surface of the delivery channel and the orifice opening itself are also typically compromised by such metalworking.

Figure 1:
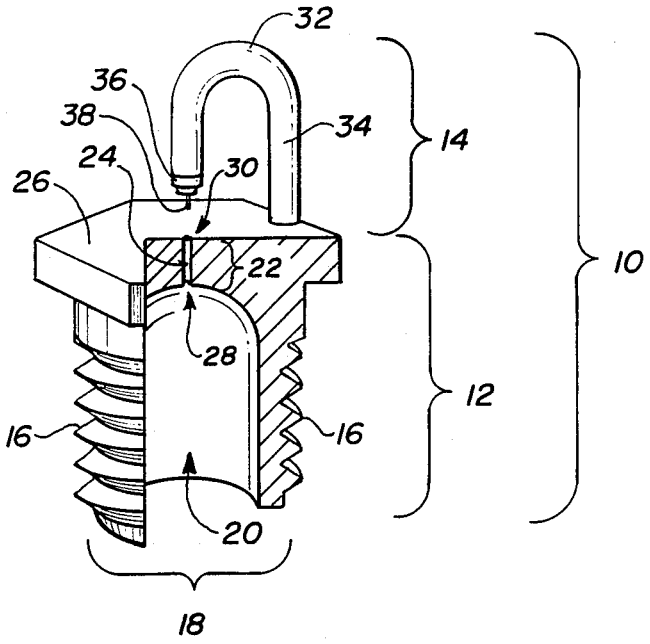
Fig. 1 PRIOR ART
FIG. 1., partly in cross-section, shows the pin jet nozzle of the Prior Art.

In the prior art nozzle, as shown in FIG. 1, a pin jet nozzle (10) is generally comprised of a base portion (12) and a pin portion (14). The base portion further comprises means for the connection of the nozzle to a pressurized hydraulic system (not shown), which means are represented as the screw threads (16). These screw threads (16) enable the nozzle to be directly connected into such a system, but other means are well known to the art and many are shown in other references. The open bottom (18) of the base portion (12) an an internal chamber (20) serves as a means for receiving fluid from the hydraulic system.

The base portion (12) is further provided with a simplistic orifice component (22), consisting of a short delivery channel (24) drilled through the cap (26) of the base portion (12). This orifice component (22) further comprises an inlet (28) and an outlet orifice (30).

The pin portion (14) of the prior art nozzle (10) comprises a support and centering means (32), which is typically an arched post (34) affixed onto or into the cap (26), having at the terminal end (36) thereof an impingement pin (38) similar in diameter to the outlet orifice (30), and positioned directly outward to said orifice at a fixed distance.

The exact dimensions of the pin, its position and the geometry of its taper are believed to be within the knowledge of one skilled in the art.

To prepare a nozzle of the prior art design, a blank base portion is drilled with a pin drill which is, typically six one-thousandths of an inch (0.006 inch) in diameter to provide the orifice. Such a drill is typically held in a stationary position while rotating stock is brought into and out of contact, allowing the drill to peck away until an orifice and delivery channel are cut. Because of the support requirements for such a narrow gauge drill, the length of the hole which may be obtained in this manner is severely limited, and rarely exceeds fifteen one-thousands of an inch (0.015 inch). Because of this shallow depth, the blank stock typically must be prepared by cutting an internal chamber sufficiently deep so that the drilling operation will reach the internal chamber to create an inlet for the orifice component.

Another hole is typically cut in the blank base to accommodate the arched post of the support and centering means, having an impingement pin at its terminal end. The depth to which the blank is cut in the previously described operation limits the depth to which the post hole can be drilled, thus somewhat limiting the support provided. An arched post is then affixed with the impingement pin centered above the outlet orifice as closely as possible. Because these holes are drilled at different times and on different equipment, alignment problems are an inherent difficulty.

Because of the nature of the drilling operation, the length of the delivery channel is severely limited. Such drilling is typically limited to about twice the diameter of the drill for practical machining purposes. The depth of a hole can exceed this limit with special machining techniques, which are difficult to maintain on a repetitive, cost-effective basis.

In addition, the drilling operation may leave gouging scars in the interior surface of the delivery channel and may chip away at the surrounding metal, leaving an imprecise mouth to the outlet orifice itself. These metalworking imperfections effect the precision of the outlet stream of fluid through the jet, and decrease the effectiveness of the nozzle.

Figure 2:
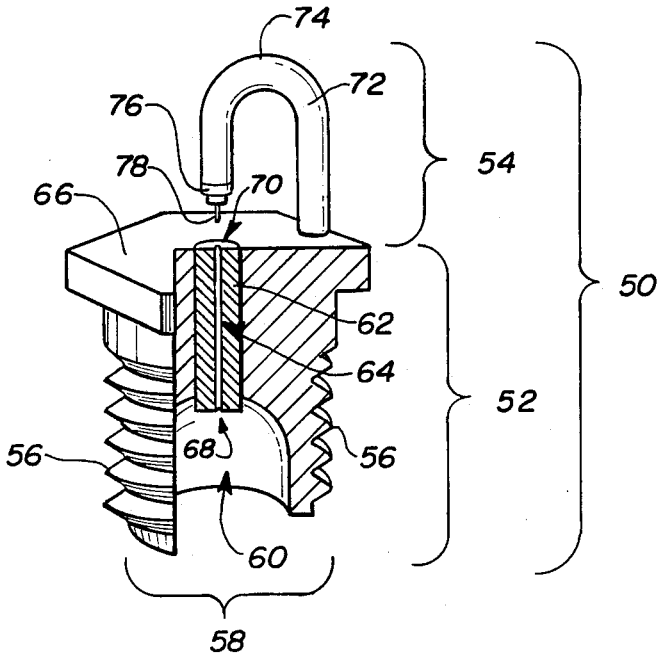
FIG. 2., partly in cross section, shows the improved pin jet nozzle of the present invention.

In the present invention, as shown in FIG. 2, a pin jet nozzle (50) is, like the prior art nozzle, generally comprised of a base portion (52) and a pin portion (54). The base portion further comprises means for the connection of the nozzle to a pressurized hydraulic system (not shown), which means are represented as the screw threads (56). These screw threads (56) enable the nozzle to be directly connected into such a system, but other means well known to the art may alternatively be employed. As in the prior art, the open bottom (58) of the base portion (52) and an internal chamber (60) serve as a means for receiving fluid from the hydraulic system, except that for reasons which will become apparent, the internal chamber (60) does not need to be cut as deeply.

Although similar in function to the simplistic orifice component of the prior art, the nozzle of the present invention has an improved orifice component (62) penetrating the cap (66) of the base portion (52). The orifice component (62) comprises an extended delivery channel (64), an inlet (68) and an outlet orifice (70). For reasons which will be discussed, the interior surface of the delivery channel is relatively free of the gouging scars typical of the drilling operation employed in the nozzle or the prior art. Further, the integrity of the outlet orifice is preserved without the surface chipping common to the prior art metalworking processes.

The pin portion (54) of the nozzle (50) of the present invention comprises a support and centering means (72) as in the prior art, which is typically an arched post (74) affixed onto or into the cap (66) of the base portion (52). The arched post (74) has at its terminal end (76) an impingement pin similar to diameter to the outlet orifice (70) and positioned directly outward to said orifice at a fixed distance.

Again, the exact dimension of the pin, its position and the geometry of its taper are believed to be within the knowledge of one skilled in the art.

To prepare a nozzle of the present invention, a blank base portion is drilled out to accommodate the insertion of an orifice component which is separately prepared. Thus, the blank base is drilled not with a pin drill, but with a drill of approximately sixty-two one-thousandths of a inch (0.062 inch). This drilling procedure, because of the great difference in size and because of the fact that it is not intended to define an opening in the finished nozzle, does not require the extreme accuracy of the drilling operation of the prior art.

The base may at the same time be drilled to accommodate the support and centering means of the pin portion and, because the blank need not be cut as deeply, the pin may be seated to a greater depth, adding to its strength and stability.

The orifice component is separately prepared from a length of extruded stainless steel tubing. The tubing of choice is a commercially available 316 Stainless Steel extruded surgical tubing with an inside diameter of six one-thousandths of an inch (0.006 inch) and an outside diameter of sixty-one one-thousandths of an inch (0.061 inch). The tubing is cut to an appropriate length, approximately one hundred thirty-five one-thousandths of an inch (0.135 inch) to yield a finished length of one hundred twenty-five one-thousandths of an inch (0.125 inch). Although the tubing is extruded, yielding a smooth and unmachined interior surface without the gouging scars of a drilling operation, cutting the tubing typically destroys the integrity of the interior openings and additional working of the tubing sections is required. This is the reason why oversize sections are initially cut.

The cut tubing sections are first treated by lapping, i.e., the tubing sections are assembled into an array and polished with an abrasive wheel to carefully remove material and regain the integrity of the orifice. Although this procedure is effective in removing most of the excess material (and opening the interior passage which may be closed off in the cutting operation), best results are obtained by providing an additional subsequent treatment.

The cut and lapped tubing sections are finally treated by electropolishing. This is a procedure similar to but effectively the reverse of electroplating. That is, the tubing sections are placed in a electrolytic solution and subjected to a mild electrical potential which effectively removes a small amount of surface material, especially any remaining burrs or irregularities which may still be present.

The tubing sections prepared in this manner have appropriate final dimension and comprise orifice components which have an interior surface free of metalworking imperfections and an orifice of high integrity.

The orifice components are inserted into the hole drilled into the blank base portion in a high tolerance press-fit engagement and affixed. This may be done by any method known to the art which will preserve the integrity of the inlet and the outlet orifice and not compromise the delivery channel. A suitable method which has been employed with success is the use of a ring stake in which a circular punch contacts the metal of the base portion surrounding the orifice component and pushes metal inward around the tubing.

Once the base portion of the nozzle has been assembled in this manner the pin portion can be added in the manner of the prior art to provide the improved pin jet nozzle of the present invention.

It will be evident that the terms and expressions that have been employed herein are used as terms of description and not of limitation. There is no intention in the use of such terms and expressions of excluding equivalents of the features shown and described or portions thereof, and it is recognized that various modifications are possible within the scope of the invention claimed.

What I claim is:

1. An improved pin jet nozzle comprising:

a base portion itself comprising means for connection of said nozzle to a pressurized hydraulic system;

means for receiving fluid from said system; and an orifice component, said orifice component comprising an inlet adapted to receive fluid from said system;

a small-diameter outlet orifice about 0.006 inch in diameter for the release of fluid from said system in the form of a jet; and a delivery channel adapted to convey fluid from said inlet to said small-diameter outlet orifice; and a pin portion itself comprising:

support and centering means; and an impingement pin member positioned over said outlet orifice and in the path of said fluid jet;

wherein the improvement comprises a delivery channel having the same diameter as said outlet orifice and having a length of at least three times its diameter.

2. The pin jet nozzle of claim 1 wherein the length of the delivery channel is at least ten times its diameter.

3. The pin jet nozzle of claim 1 wherein the length of the delivery channel is at least twenty times its diameter.

4. The pin jet nozzle of claim 1 wherein the orifice component is stainless steel.

5. The pin jet nozzle of claim 1 wherein the base portion is stainless steel.

6. The pin jet nozzle of claim 1 wherein the pin portion is stainless steel.

* * * * *